US012471691B2

(12) United States Patent
Chabrerie

(10) Patent No.: US 12,471,691 B2
(45) Date of Patent: Nov. 18, 2025

(54) DEVICE FOR DISPENSING AND APPLYING STICK-SHAPED COSMETIC PRODUCT

(71) Applicant: COSMOGEN SAS, Paris (FR)

(72) Inventor: Hugues Chabrerie, Issy-les-Moulineaux (FR)

(73) Assignee: COSMOGEN SAS, Paris (FR)

( * ) Notice: Subject to any disclaimer, the term of this patent is extended or adjusted under 35 U.S.C. 154(b) by 0 days.

(21) Appl. No.: 18/999,306

(22) Filed: Dec. 23, 2024

(65) Prior Publication Data

US 2025/0127279 A1 Apr. 24, 2025

Related U.S. Application Data

(63) Continuation of application No. PCT/FR2023/050941, filed on Jun. 22, 2023.

(30) Foreign Application Priority Data

Jun. 24, 2022 (FR) ..... 22/06341

(51) Int. Cl.
*A45D 40/04* (2006.01)
*A45D 40/12* (2006.01)
*A45D 40/20* (2006.01)

(52) U.S. Cl.
CPC ..... *A45D 40/04* (2013.01); *A45D 40/12* (2013.01); *A45D 2040/208* (2013.01)

(58) Field of Classification Search
CPC ... A45D 40/04; A45D 40/12; A45D 2040/208
USPC ..... 401/68
See application file for complete search history.

(56) References Cited

U.S. PATENT DOCUMENTS 6,340,258 B2 * 1/2002 Gueret ..... A45D 40/04 401/98
9,474,350 B2 * 10/2016 Thompson ..... A45D 40/205

FOREIGN PATENT DOCUMENTS

| | | |
|---|---|---|
| CN | 216255929 | 4/2022 |
| WO | 2008029375 | 3/2008 |
| WO | 2021030719 | 2/2021 |
| WO | 2021084281 | 5/2021 |

OTHER PUBLICATIONS

International Search Report issued in corresponding International Application PCT/FR2023/050941, mailed Oct. 9, 2023.

* cited by examiner

*Primary Examiner* — Jennifer C Chiang
(74) *Attorney, Agent, or Firm* — Burris Law, PLLC

(57) ABSTRACT

A device for dispensing and applying a cosmetic product wherein the cosmetic product is movable between a position retracted into the device and a position deployed out of the device includes a receptacle for the cosmetic product and a sheath forming a housing for the receptacle. The sheath covers the cosmetic product when the cosmetic product is in the position retracted into the device, and at least partially uncovers the cosmetic product when the cosmetic product is in the position deployed out of the device. The device further includes a rotating mechanism configured to create a relative displacement between the sheath and the receptacle to allow the cosmetic product to move between the position retracted into the device and the position deployed out of the device and a base forming a housing for the rotating mechanism. The base and sheath are made of cardboard.

11 Claims, 6 Drawing Sheets

DEVICE FOR DISPENSING AND APPLYING STICK-SHAPED COSMETIC PRODUCT

CROSS-REFERENCE TO RELATED APPLICATIONS

This application is a continuation of International Application No. PCT/FR2023/050941, filed on Jun. 22, 2023, which claims priority to and the benefit of FR 22/06341, filed on Jun. 24, 2022. The disclosures of the above applications are incorporated herein by reference in their entireties.

FIELD

The present disclosure relates to the field of devices for dispensing and applying cosmetic products (also called cosmetic applicators), and more particularly to stick-shaped solidified products, such as lipsticks or deodorant.

BACKGROUND

The statements in this section merely provide background information related to the present disclosure and may not constitute prior art.

Cosmetic products are products intended to be brought into contact with parts of the human body in order to clean them, perfume them, change their appearance, protect them, keep them in good condition or correct body odors. Cosmetic products are, for example, skin make-up products or perfume or odorous compositions intended for body application.

Typically, cosmetic applicators comprise a case comprising a receptacle for a cosmetic product. The receptacle is generally movable relative to the case and configured to be moved, in particular in translation, so as to drive the cosmetic product between a position retracted into the case and a position deployed out of the case to allow application of the cosmetic product.

The receptacle may comprise a cup or a tray.

In one form, the case comprises a rotating mechanism comprising two elements that can be actuated in rotation relative to each other to cause an axial translational movement of the receptacle. The rotating mechanism is configured to cooperate with the receptacle so as to drive it in axial translation inside the case. Thus, when the rotating mechanism is actuated, the receptacle is driven in translation inside the case. Such a rotating mechanism gives the user an aesthetic and pleasant gesture when handling the applicator.

The materials used for the manufacture of such an applicator are generally metal and/or plastic.

In order to reduce the amount of plastic, it is known to manufacture applicators comprising a cardboard case. The case in particular helps protect the cosmetic product and facilitates the handling of the applicator. It also helps give the applicator a pleasant aesthetic.

Applicators of this type, with a cardboard case, slightly reduce the use of plastic, but allow maintaining an elaborate gesture.

In order to further reduce the amount of plastic used, it is known to manufacture 100% cardboard applicators that do not comprise a rotating mechanism.

In this type of applicator, the receptacle is a tray configured to be pushed by the user in order to drive the cosmetic product from the position retracted into the case to the position deployed out of the case.

A disadvantage of this form is that it does not allow switching from the deployed position to the retracted position. In addition, the gesture is not very aesthetic and pleasant.

SUMMARY

This section provides a general summary of the disclosure and is not a comprehensive disclosure of its full scope or all of its features.

The present disclosure relates to a device for dispensing and applying a cosmetic product wherein the cosmetic product is movable between a position retracted into the device and a position deployed out of the device, the device comprising: A receptacle for the cosmetic product; A sheath forming a housing for the receptacle, the sheath being configured to cover the cosmetic product when the cosmetic product is in a position retracted into the device, and to at least partially uncover the cosmetic product when the cosmetic product is in a position deployed out of the device; A rotating mechanism configured to create a relative displacement between the sheath and the receptacle to allow the cosmetic product to move between the position retracted into the device and the position deployed out of the device; and a base forming a housing for the rotating mechanism; wherein the base and the sheath are made of cardboard.

Thus, the device according to the present disclosure allows both maintaining an aesthetic and pleasant user gesture, and improving recycling by considerably reducing the use of plastic.

By cardboard it should be understood a paper material whose mass is greater than or equal to 200 g/m$^2$, and more particularly a paper material whose mass is greater than or equal to 224 g/cm$^2$.

For example, the rotating mechanism comprises a first element and a second element movable in rotation relative to each other, wherein the first element is fastened to the sheath and the second element is fastened to the receptacle.

In the following description, by "fastened" it should be understood secured, so that the elements fastened together are movable together.

For example, the sheath and the first element of the rotating mechanism are fastened by gluing or by clamping or by snap-fitting. The sheath is therefore secured to the first element of the rotating mechanism. The term snapping also means clipping.

For example, the first element and the second element of the rotating mechanism comprise a helical connection. Thus, the first element and the second element are movable in rotation and in translation relative to each other.

For example, the base is fastened to the second element of the rotating mechanism, by gluing or by clamping or by snap-fitting. The base is therefore secured to the second element of the rotating mechanism.

For example, the second element comprises a threaded rod and the first element comprises a complementary thread.

For example, the second element is integral with the receptacle.

For example, the sheath is configured to translate in the base upon actuation of the rotating mechanism.

For example, the base and the sheath are cylindrical. Thus, the device is simplified so that the manufacture of parts, in particular made of cardboard, is simplified.

For example, the rotating mechanism is made of plastic. This makes it easier to handle the device.

In the case of a clamping or snap-fitting fastening, the rotating mechanism can be manually separated from the sheath and the base, in order to facilitate sorting of plastic parts and cardboard parts, to enable recycling of the device.

For example, plastic is biodegradable and/or recyclable. This makes it easier to recycle the device.

For example, the rotating mechanism comprises a blocking means configured to block the rotation of the rotating mechanism. For example, the blocking means is configured to block the rotating mechanism in the retracted position. This allows positioning the sheath so as to allow insertion of the cosmetic product into the device.

For example, the blocking means comprises a means for connecting the first element to the second element so as to block the rotation of the first element relative to the second element.

For example, the device comprises a cover configured to cooperate with the base.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
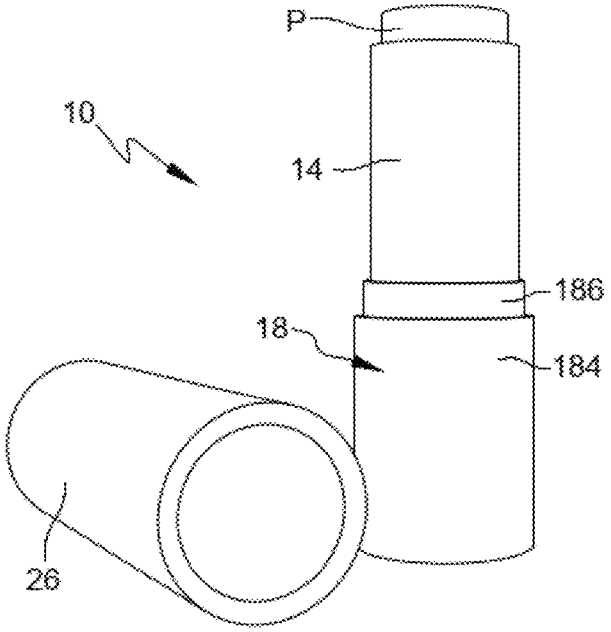
FIG. 1 is a schematic perspective view of the device for dispensing and applying a cosmetic product, according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following description and in the claims, identical, similar or analogous components will be designated by the same reference numbers in order to facilitate the description.

Figure 2:
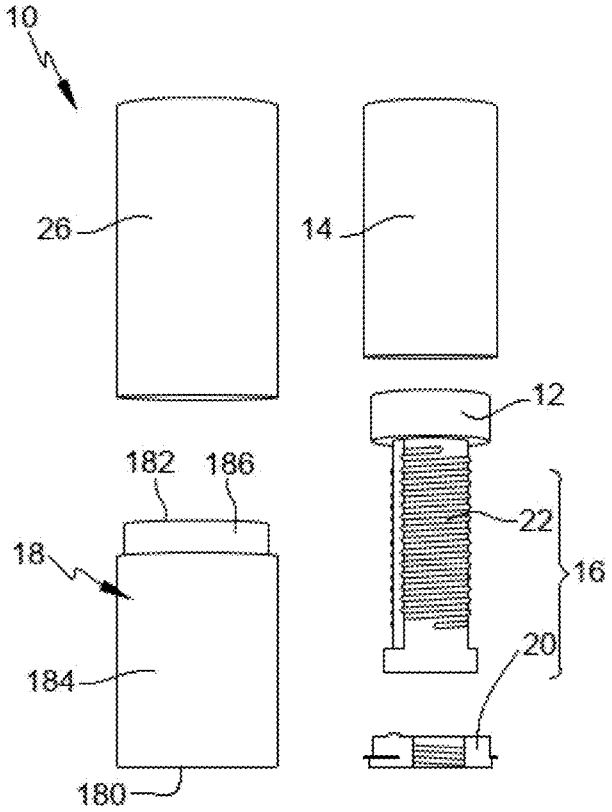
FIG. 2 is an exploded view of the device of FIG. 1.
Figure 3:
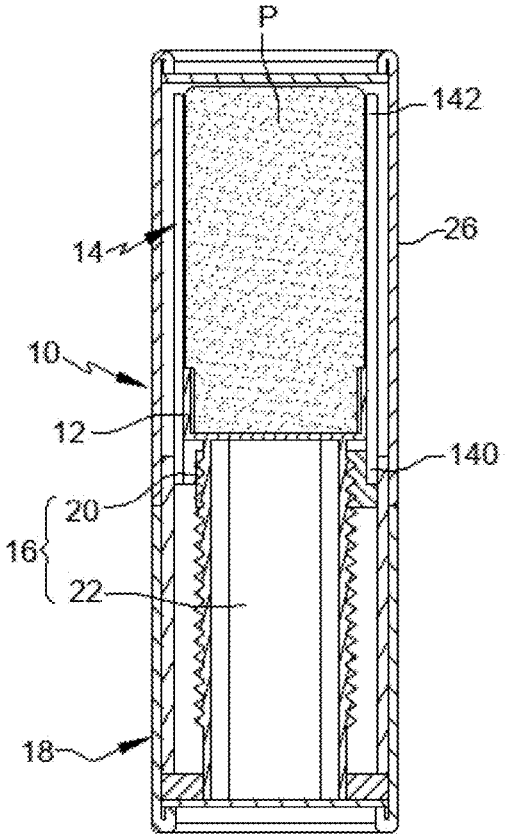
FIG. 3 is a schematic sectional view of the device of FIG. 1.

FIGS. 1 to 3 represent a device 10 for dispensing and applying a cosmetic product P. The cosmetic product P can be a lipstick or a deodorant composition, for example.

The device 10 comprises a receptacle 12 for the cosmetic product P, a sheath 14 configured to house the receptacle 12, a rotating mechanism 16 configured to create a relative displacement between the sheath 14 and the receptacle 12, and a base 18 configured to house the rotating mechanism 16.

The rotating mechanism 16 is configured to allow the cosmetic product P to move between the position retracted into the device 10 and the position deployed out of the device 10.

The rotating mechanism can impart a relative translational movement between the sheath 14 and the receptacle 12.

The receptacle 12 may comprise a cup or a tray.

Figure 4:
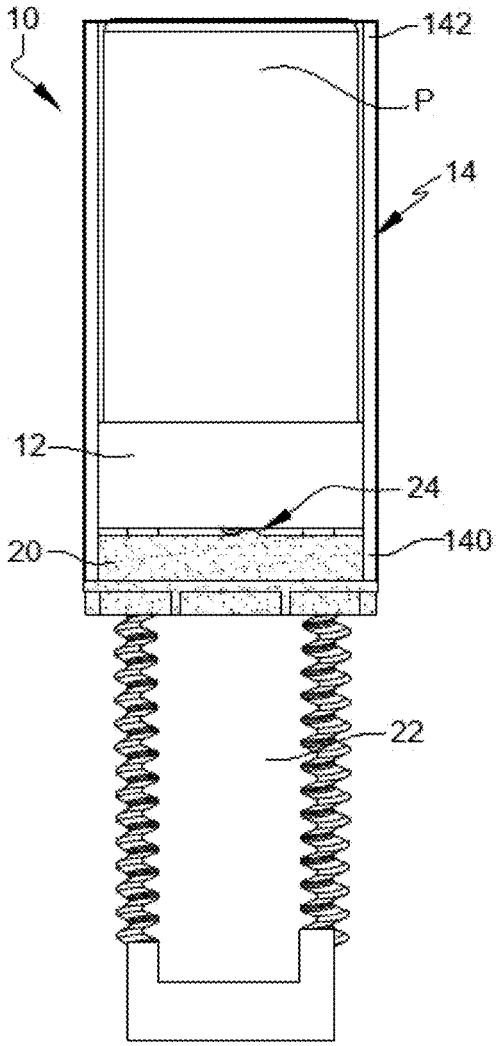
FIG. 4 is a partial schematic view of the device of FIG. 1, the cosmetic product being in the position retracted into the device.
Figure 5:
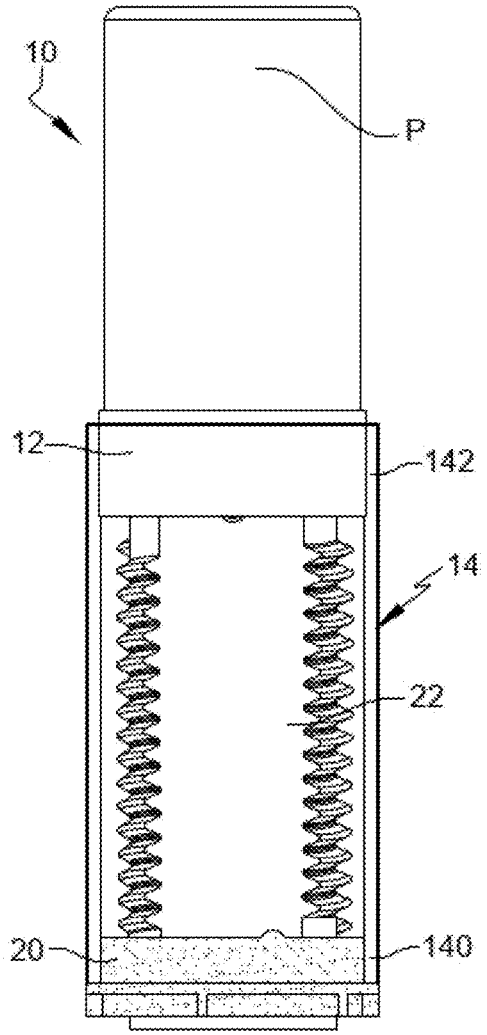
FIG. 5 is a partial schematic view of the device of FIG. 1, the cosmetic product being in the position deployed out of the device.

The sheath 14 forms a housing for the receptacle 12. More particularly, the sheath 14 can form a housing for the receptacle 12 and the cosmetic product P. The sheath 14 is configured to cover the cosmetic product P when the cosmetic product P is in the position retracted into the device 10 (FIG. 4). The sheath 14 is configured to at least partially uncover the cosmetic product P when the cosmetic product P is in the position deployed out of the device (FIG. 5).

The sheath 14 and the base 18 are made of cardboard.

The rotating mechanism 16 may comprise plastic such as polypropylene, polybutylene terephthalate (PBT), or polyethylene terephthalate (PET). The rotating mechanism 16 may comprise biodegradable plastic such as polylactic acid (PLA), polyhydroxyalkanoate (PHA), or polybutylene succinate (PBS). The rotating mechanism 16 may comprise recyclable plastic such as polypropylene (PP) or high-density polyethylene (HDPE).

Thus, the device 10 is composed mainly of cardboard (at least 51% by weight) which makes it easier to recycle the device 10. Indeed, the device 10 is capable of being recycled in the paper/cardboard industry, and if the plastic used is recyclable then they will also be recycled. On the other hand, if the device 10 includes less than 51% by weight of cardboard, it will be recycled in the plastic industry and the cardboard elements will not be recycled.

The sheath 14 may be cylindrical to facilitate its manufacture. More specifically, the sheath 14 may be a hollow cylinder.

The sheath 14 may have a thickness in the range of 1 to 2 mm.

The sheath 14 can also be called a ring or casing.

The base 18 forms a housing for the rotating mechanism 16.

The base 18 may be cylindrical to facilitate its manufacture. More specifically, the base 18 may be a hollow cylinder.

The base 18 may have a thickness in the range of 1 to 2 mm.

The cosmetic product P is movable between a position retracted into the device 10 (FIG. 4) and a position deployed out of the device 10 (FIG. 5). In the position retracted into the device 10, the cosmetic product is inserted into the device 10. In the position deployed out of the device 10, the cosmetic product projects from the device 10.

The rotating mechanism 16 may be fastened to the sheath 14 and the receptacle 12. The rotating mechanism 16 may be a twist mechanism.

The rotating mechanism 16 may comprise two elements 20, 22 movable in rotation relative to each other. For example, one of the two elements 20, 22 is fastened to the sheath 14 and the other of the two elements 20, 22 is fastened to the receptacle 12. Each of the two elements 20, 22 may be fastened respectively to the sheath 14 and the receptacle 12.

The sheath 14 may be fastened to one of the two elements 20, 22 by gluing. Alternatively, the sheath 14 may be integral with one of the two elements 20, 22. The receptacle 12 may be fastened to one of the two elements 20, 22 by gluing. Alternatively, the receptacle 12 may be integral with one of the two elements.

The two elements 20, 22 of the rotating mechanism 16 may comprise a helical connection. In other words, the two elements 20, 22 may be connected by a helical connection. The two elements 20, 22 may cooperate by a helical connection. The two elements 20, 22 may be movable in rotation relative to each other by a helical connection.

More particularly, the rotating mechanism 16 may comprise a first element 20 and a second element 22. The first element 20 and the second element 22 may be movable in rotation relative to each other. The first element 20 and the second element 22 may be fastened respectively to the sheath 14 and the receptacle 12.

For example, the first element 20 is fastened to the sheath 14 and the second element 22 is fastened to the receptacle 12. The sheath 14 and the first element 20 of the rotating mechanism 16 may be fastened by gluing. Alternatively, the sheath 14 may be integral with the first element 20. Alternatively, the sheath 14 and the first element 20 of the rotating mechanism 16 may be fastened by snap-fitting. Alternatively, the sheath 14 and the first element 20 of the rotating mechanism 16 may be fastened by clamping. The receptacle 12 may be fastened to the second element 22 by gluing. Alternatively, the receptacle 12 may be integral with the second element 22. Alternatively, the receptacle 12 may be fastened to the second element 22 by snap-fitting. Alternatively, the receptacle 12 may be fastened to the second element 22 by clamping.

The sheath 14 may comprise a first end 140 fastened to the first element 20. The sheath 14 may comprise a second open end 142. The second end 142 may allow the passage of the cosmetic product P between the position retracted into the device 10 and the position deployed out of the device 10.

Figure 6:
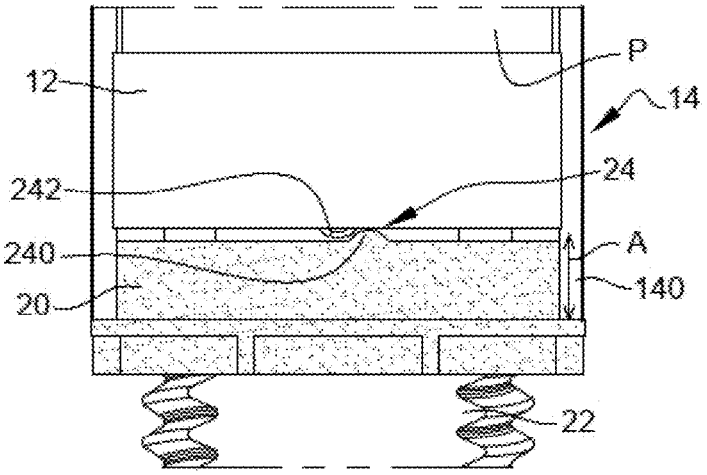
FIG. 6 is a schematic view of a detail of FIG. 4, illustrating a means for blocking the rotating mechanism.

The first end 140 may be fastened to the first element 20 on a gluing area A corresponding to the height of the first element 20 (FIG. 6).

In the position retracted into the device 10, the first element 20 may be in contact with the receptacle 12.

The first element 20 and the second element 22 of the rotating mechanism 16 may comprise a helical connection. In other words, the first element 20 and the second element 22 may be connected by a helical connection. The first element 20 and the second element 22 may cooperate by a helical connection. The first element 20 and the second element 22 may be movable in rotation relative to each other by a helical connection.

The second element 22 may comprise a threaded rod. The first element 20 may comprise a complementary thread. The first element 22 may comprise a nut comprising the complementary thread.

The base 18 can be fastened to the second element 22 of the rotating mechanism 16, for example by gluing.

The base 18 may form a housing for the sheath 14. The sheath 14 may be configured to translate in the base 18 between an outer position (FIG. 4) and an inner position (FIG. 5), upon actuation of the rotating mechanism 16. The outer position may correspond to the retracted position of the cosmetic product P into the device 10. The inner position may correspond to the deployed position of the cosmetic product P into the device 10.

The sheath 14 may be configured to translate into the base 18 via engagement of the threads of the first element 20 and the second element 22.

The base 18 may comprise a first closed end 180 and a second open end 182. The second end 182 may allow the insertion of the rotating mechanism 16. The second end 182 may allow the translation of the sheath. The second element 22 of the rotating mechanism 16 may be fastened to the first end 180 of the base 18.

The second end 182 may allow the passage of the sheath 14 between the outer position and the inner position.

The device 10 may comprise a cover 26 configured to cooperate with the base 18. The cover 26 may be configured to be sleeved onto the base. The cover 26 may be configured to be sleeved onto the second end 182 of the base 18.

The base 18 may comprise two cardboard sheets 184, 186 connected by gluing or clamping so as to form a single piece. More specifically, the base 18 may comprise an outer cardboard sheet 184 and an inner cardboard sheet 186. The inner cardboard sheet 186 is sized relative to the outer cardboard sheet 184 so as to form an axial protuberance which projects from the outer cardboard sheet 184 on the side opposite the closed end 180 of the base 18. The axial protuberance has a height adapted to allow positioning and holding of the cover 26 on the base 18.

FIGS. 4 and 5 illustrate the operation of the device 10 as previously described.

The cosmetic product P is movable between a position retracted into the device 10 (FIG. 4) and a position deployed out of the device 10 (FIG. 5).

As shown in FIG. 4, when the cosmetic product P is in the position retracted into the device 10, the sheath 14 covers the cosmetic product P. Thus, the sheath 14 allows protecting the cosmetic product P in particular from impacts and drying out.

The cosmetic product P is configured to have side walls configured to be in contact with the sheath 14. The sheath 14 can cover the side walls of the cosmetic product 14 when the cosmetic product P is in the position retracted into the device 10.

When a user actuates the rotating mechanism 16, a relative displacement between the sheath 14 and the receptacle 12 is created, to allow the cosmetic product P to move between the position retracted into the device 10 and the position deployed out of the device 10.

More specifically, the user can rotate the rotating mechanism 16 to cause an axial movement between the position retracted into the device 10 and the position deployed out of the device 10.

More specifically, upon actuation of rotating mechanism 16, the first element 20 can be rotated relative to the second element 22. The first element 20 can then perform a simultaneous rotational and translational movement around the second element 22. The first element 20 can drive in translation the sheath 14 so as to at least partially uncover the cosmetic product P. The cosmetic product P switches from the position retracted into the device 10 (FIG. 4) to the position deployed out of the device (FIG. 5).

The sheath 14 can translate in the base 18. The sheath 14 can be housed in the base 18.

The operation of the device 10 is simple.

FIGS. 4 and 6 show that the rotating mechanism 16 may comprise a blocking means 24 configured to block the rotation of the rotating mechanism 16. The blocking means 24 may be configured to block the rotation of the rotating mechanism 16 by cooperation between the two elements 20, 22 of the rotating mechanism 16. The blocking means 24 may be configured to block the rotation of the rotating mechanism 16 by cooperation between the first element 20 and the second element 22 of the rotating mechanism 16. The blocking means 24 may be configured to block the rotation of the rotating mechanism 16 by cooperation between the first element 20 of the rotating mechanism 16 and the receptacle 12.

The blocking means 24 may comprise a means for connecting the two elements 20, 22 of the rotating mechanism 16, so as to block the relative movement between the two elements 20, 22. The blocking means 24 may comprise a means for connecting the first element 20 to the second element 22 of the rotating mechanism 16, so as to block the relative movement between the first element 20 and the second element 22.

The blocking means 24 may comprise a means for connecting the first element 20 of the rotating mechanism 16 to the receptacle 12, so as to block the relative movement between the first element 20 and the second element 22 in the retracted position.

The blocking means 24 may comprise an anti-rotation notch.

The blocking means may comprise a male element 240 configured to engage in a female element 242. The male element 240 and the female element 242 may be disposed respectively on the first element 20 and the second element 22. The male element 240 and the female element 242 may be disposed respectively on the first element 20 and the receptacle 12.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A device for dispensing and applying a cosmetic product wherein the cosmetic product is movable between a position retracted into the device and a position deployed out of the device, the device comprising:

a receptacle for the cosmetic product;

a sheath forming a housing for the receptacle, the sheath being configured to cover the cosmetic product when the cosmetic product is in the position retracted into the device, and to at least partially uncover the cosmetic product when the cosmetic product is in the position deployed out of the device;

a rotating mechanism configured to create a relative displacement between the sheath and the receptacle to allow the cosmetic product to move between the position retracted into the device and the position deployed out of the device, the rotating mechanism comprising a first element and a second element movable in rotation relative to each other, the first element being fastened to the sheath and the second element being fastened to the receptacle, the second element comprising a threaded rod and the first element comprising a complementary thread; and a base forming a housing for the rotating mechanism, wherein the base and the sheath are made of cardboard.

2. The device according to claim 1, wherein the sheath and the first element of the rotating mechanism are fastened by at least one of gluing, clamping, and snap-fitting.

3. The device according to claim 1, wherein the first element and the second element of the rotating mechanism comprise a helical connection.

4. The device according to claim 1, wherein the base is fastened to the second element of the rotating mechanism by at least one of gluing, clamping, and snap-fitting.

5. The device according to claim 1, wherein the second element is integral with the receptacle.

6. The device according to claim 1, wherein the sheath is configured to translate in the base upon actuation of the rotating mechanism.

7. The device according to claim 1, wherein the base and the sheath are cylindrical.

8. The device according to claim 1, wherein the rotating mechanism comprises plastic.

9. The device according to claim 1, wherein the rotating mechanism comprises a blocking means configured to block the rotation of the rotating mechanism.

10. The device according to claim 9, wherein the blocking means comprises a means for connecting the first element to the second element so as to block the rotation of the first element relative to the second element.

11. The device according to claim 1, further comprising a cover configured to cooperate with the base.

* * * * *